United States Patent [19]

Bender

[11] 4,388,837

[45] Jun. 21, 1983

[54] POSITIVE ENGAGEMENT FAIL SAFE MECHANISM AND LIFT BELT CONSTRUCTION FOR LONG STROKE, WELL PUMPING UNIT

[76] Inventor: Emil A. Bender, 6625 Kane Way, Bakersfield, Calif. 93309

[21] Appl. No.: 393,102

[22] Filed: Jun. 28, 1982

[51] Int. Cl.[3] ..... F16H 27/02

[52] U.S. Cl. ..... 74/89.2; 187/81; 188/65.1

[58] Field of Search ..... 74/89.2, 89.21, 89.22; 187/81, 80, 83; 188/65.1

[56] References Cited

U.S. PATENT DOCUMENTS

| | | | |
|---|---|---|---|
| 973,518 | 10/1910 | Kulp | 187/81 |
| 3,248,958 | 5/1966 | Bender | 74/89.20 |
| 3,483,828 | 12/1969 | Bender | 74/590 X |
| 3,538,777 | 11/1970 | Bender | 74/37 |
| 3,777,491 | 12/1973 | Bender | 60/372 |
| 3,792,836 | 2/1974 | Bender | 254/139 |
| 3,986,564 | 10/1976 | Bender | 172/4 |

*Primary Examiner*—Richard E. Gluck

*Attorney, Agent, or Firm*—Quaintance & Murphy

[57] ABSTRACT

A self-energizing, positive engagement, fail safe mechanism for long stroke, well pumping units, whether powered mechanically or hydraulically, and which employ a lift belt. Upon failure of the sucker rod, polish rod or lift belt, a wedge shoe breaking arrangement drops and engages to jamb the lift belt against a stationary brake beam. Any continued movement of the belt only forces the safety wedge shoe brake arrangement into tighter engagement with the lift belt and brake beam. The lift belt is attached to the yoke supporting the polish rod by a bracket, dual clamping plate, bolt, and nail or pin assemblage. This same assemblage may be used to attach a counterweight to the lift belt.

10 Claims, 5 Drawing Figures

POSITIVE ENGAGEMENT FAIL SAFE MECHANISM AND LIFT BELT CONSTRUCTION FOR LONG STROKE, WELL PUMPING UNIT

BACKGROUND OF THE INVENTION

This invention relates generally to well pumping units and more particularly to an improved safety brake assembly for shutting down operation of the pumping unit in the event of failure of one or more components on the lift side of the pumping unit, when under load. Such failures, although rare, have disastrous consequences both for personnel in the area and the equipment being used.

The present invention has utility with a wide variety of well pumping units, particularly of the kind that I have developed. In general, such a well pumping unit includes a tower mounted on a base platform with a top platform surmounting the tower, a source of power and a winding drum on the base platform, a lift belt made of conveyor belting from the winding drum up the tower to a spool mounted on the top platform and then extended downwardly and connected to the polish rod of a well pump, and a reversing mechanism associated with the power means to reciprocate the belt and thus the polish rod and thereby operate the pump. A counterbalance or counterweight is provided in that portion of the drive belt between the spool and the winding drum so that power requirements of the pumping unit are kept to a minimum.

The need for a fail safe mechanism is particularly acute during a lifting stroke of the pumping unit. The polish rod load may well be in the area of, for example, from 10,000 to 30,000 pounds and the counterbalance will be weighted only somewhat less than the polish rod load. If that portion of the lift belt between the spool on the top platform and the polish rod should fail or if one or more of the polish rod, rod string and sucker rod components of the well pump should fail, the lift belt will unravel from the spool as the counterbalance falls to the base platform; the possible, disastrous consequences are self-evident. Accordingly, this invention provides a mechanism for immediately locking or trapping the lift belt in place in the event of a failure as just described.

A brief description of the need for, and development of, well pumping units is in order. In the early life of a well, reservoir pressure alone may be sufficient to raise the oil to the surface, providing local regulatory authorities permit such a procedure. In any event, eventually the oil will have to be pumped to the surface to be recovered. The most common variety of pump employed for this purpose is a walking beam pump having a nominal stroke distance of from about seven to twelve feet. Such pumps are inefficient and inoperable in wells having depths approaching one, two or more miles. In such cases, rod stretch alone will approach and eventually equal the stroke distance of a walking beam pump, making such a pump completely useless.

Accordingly, longer stroke well pumping units, particularly useful in deep wells, have been developed, some of which have stroke lengths of thirty-two feet or more. One example of such a prior art long stroke pumping unit is the "Oilwell" Model 3534 Long Stroke Pumping Unit, manufactured by Oilwell, a division of United States Steel. The unit includes a central tower having multiple guides to stabilize the structure, a complex multi-strand cable crown block assembly suspending the rod string and a variable capacity counterweight and, of course, a prime mover. Several safety systems are provided, including an automatic air brake system controlled by an overspeed governor flyweight responsive when the counterweight exceeds a predetermined, acceptable downward speed. Other safety features include interlocked controls and automatic breaking in the event of an air loss or power failure. Both the pumping unit and the safety features provided are complicated and quite expensive.

My own prior U.S. Pat. No. 3,248,958, discloses and claims a wire line deep well pumping apparatus and a safety brake system was developed for this deep well pumping unit which included a somewhat complex system for jamming a cam against the wire lines in the top platform mounted sheaves in the event of rod string failure, thus preventing the counterweight from falling. In my prior U.S. Pat. No. 3,483,828, which also disclosed a deep well pumping unit, a braking system was generally described which was actuated in the event of failure; the brake could also be used to hold the apparatus in a static position while the well was being serviced.

Other long stroke, deep well pumping units that I have invented are disclosed in my prior U.S. Pat. Nos. 3,483,828; 3,538,777; 3,777,491; 3,792,836; and 3,986,564. A hydraulically operated deep well pumping unit employing a single, wide strap or belt as the operative connection between the winding drum and the polish rod of the pump is shown in FIGS. 4 and 5 of my above-mentioned U.S. Pat. No. 3,777,491. A yoke assembly somewhat similar to that disclosed and claimed below is also disclosed in FIG. 5 of that same patent.

However, the prior art does not disclose a completely reliable, fail safe mechanism for use with well pumping units of the type above described and which is of uncomplicated structure and requires no power means in order to be operated. Additionally, the prior art does not disclose the yoke assembly herein disclosed and claimed for attaching the lift belt above described to the polish rod upper end. Of course, this invention is useful in wells of all depths which particularly enhances the universality of its application.

SUMMARY OF THE INVENTION

Therefore, it is a principal object of this invention to provide a fail safe mechanism for a well pumping unit or the like which is completely mechanical in structure and operation and thus has no power requirements and which is operable to quickly shut down operation of the pumping unit in the event of failure of one or more of the components of the pumping unit, particularly during an under load situation.

It is another object of the invention to provide a fail safe mechanism for a well pumping unit which includes a base platform, tower and top platform upon which a spool is mounted, a lift belt being trained thereover and connected at its ends to the polish rod and winding drum of the pump, the lift belt being the connective component for imparting reciprocation to the polish rod and rod string of the pump, the lift belt being provided with a counterweight between the spool and winding drum and the fail safe mechanism being located above the counterweight and operable upon failure of one or more of the rod string components to securely engage and lock the lift belt to prevent the counterweight from falling.

It is yet another object of the invention to provide a fail safe mechanism for a well pumping unit or the like which requires little or no maintenance.

It is a further object of the invention to provide a fail safe mechanism for a well pumping unit or the like which, when actuated, operates only to more securely lock components in place after failure of the unit.

Still another object of the invention is to provide a yoke assembly interconnecting the polish rod of a well pump and the operative component of a well pumping unit imparting reciprocatory movement to the polish rod, which yoke assembly provides a connection having greater strength than either the component or the polish rod.

Generally speaking, the long stroke, well pumping unit with which the invention may be used includes a base platform, a tower on the platform, and a top platform surmounting the tower. A rotatable winding drum is located on the platform with a mechanical or hydraulic drive to impart rotation to the winding drum. A flexible lift belt is attached at one end to the winding drum and at its other end to the upper, terminal end of the polish rod of a well pump. A freely rotatable spool is located atop the top platform and the lift belt is trained over the rotatable spool. A counterweight is located on the lift belt, between the winding drum and the spool. A reversing mechanism is associated with the hydraulic or mechanical drive for the winding drum to thereby provide reciprocating movement through the lift belt to the polish rod. The self-energizing, positive engagement, fail safe mechanism of the invention, which terminates operation of the pumping unit in the event of failure by fracture of the lift belt below the spool, polish rod, rod string or sucker rod, includes a lever platform pivotally mounted on the top platform, the spool being freely rotatably mounted on the lever platform, a braking beam located on the top platform immediately adjacent that portion of the lift belt between the spool and the winding drum and a wedge actuated braking shoe structure, pivotally suspended from the lever platform and also located adjacent the lift belt opposite the braking beam whereupon failure by fracture as just described, the lever platform pivots downwardly to jamb the braking shoe against the braking beam thus to grasp and secure the lift belt and prevent the counterweight from falling. The novel yoke assembly of the invention includes a crossbar, the pump polish rod being suspended medially from the cross bar, a pair of vertical brackets at each end of the cross bar and a pair of clamping plates engaging the lower end of the lift belt of a well pumping unit as just described, the clamping plates including a patterned array of pins inserted through both the clamping plates and the lift belt end, the pins being arrayed in horizontal rows from the bottom to the top of the clamping plates and the number of pins in each row decreasing in count from the bottom to the top of the clamping plates.

Further novel features and other objects of this invention will become apparent from the following detailed description, discussion and the appended claims taken in conjunction with the accompanying drawings.

BRIEF DESCRIPTION OF THE DRAWINGS

A preferred structural embodiment of this invention is disclosed in the accompanying drawings in which.

DESCRIPTION OF THE PREFERRED EMBODIMENT

Figure 1:
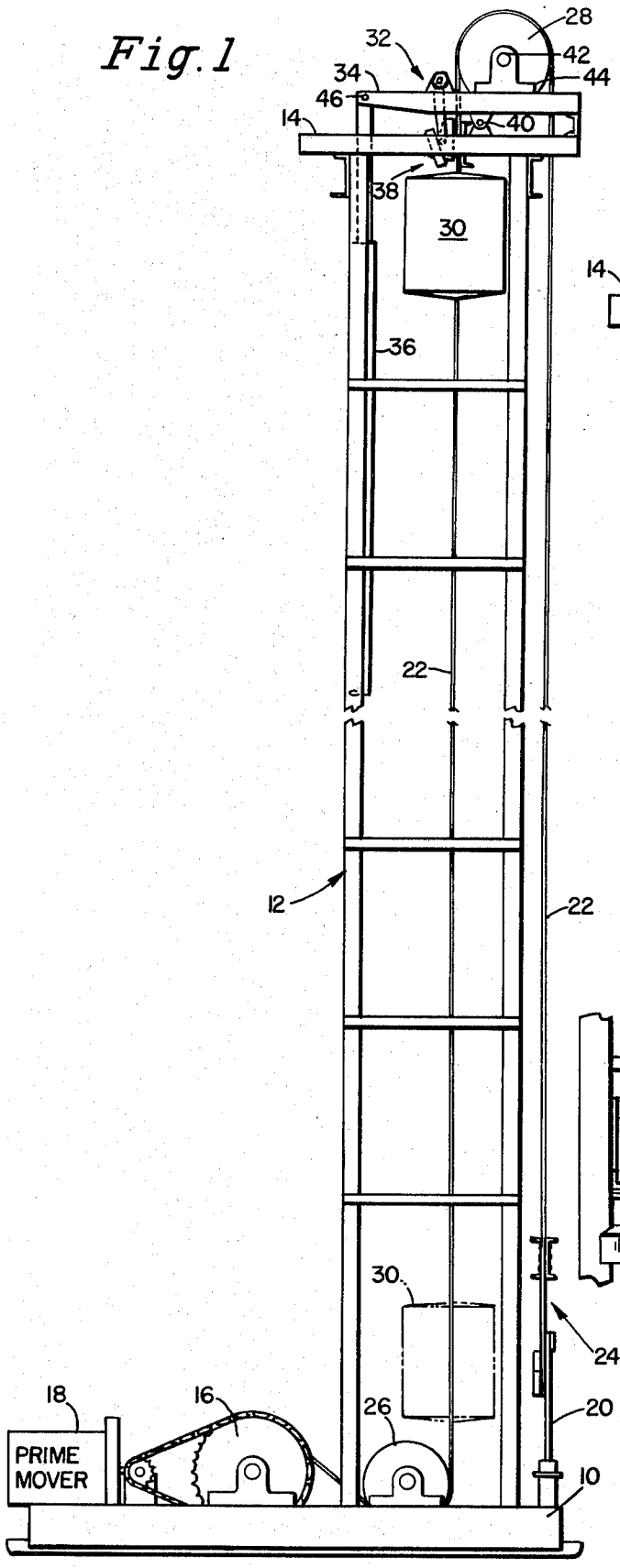
FIG. 1 is a partial, side elevation view of a well pumping unit of this invention.

Referring now to the drawings by reference character, and in particular to FIG. 1 thereof, a simplified, long stroke, well pumping unit is illustrated including a skid mounted base platform 10, a tower structure 12 on the base, and a top platform 14 surmounting the tower structure. A rotatable winding drum 16 is located on base platform 10 and is driven from a suitable power source 18 which may be mechanically or hydraulically driven and is also located on base platform 10. A reversing mechanism (not shown) is also provided in association with the power source for periodically reversing rotation of the winding drum in a manner described in greater detail hereinbelow. An otherwise conventional well pump (not shown) includes a rod string and sucker rod therein, topped by a conventional polish rod 20. A flexible lift belt 22 is secured at one end to rotatable winding drum 16 and at the other end to a yoke assembly 24 from which polish rod 20 is centrally suspended. Flexible lift belt 22 is reaved beneath an idler pulley 26 on base platform 10, then upwardly through tower 12 to and over a spool 28, freely rotatably mounted atop the top platform 14 and then vertically downwardly to yoke assembly 24. A counterweight 30 is attached to or interposed within lift belt 22 and reciprocates vertically, with movement of lift belt 22, between the upper and lower ends of the tower structure 12. During operation of the pumping unit, the reversing mechanism (not shown) allows belt 22 to be wound upon and unwound from winding drum 16 to thus impart reciprocating movement to polish rod 20 and the well pump.

As mentioned above, commercially available conveyor belting may be employed as the material for lift belt 22. One available brand of conveyor that might be used is that sold under the trademark "Unilok" as "PolyVinylok" conveyor belting. One particular material found to be useful is Unilok's PVK-350 material, a belting that is 10/32 inches thick, 15 inches wide and has an ultimate tensile strength at rupture of 3500 pounds per inch. Similar belting materials sold under the Unilok mark are available, up to 15/32 inches thick and having an ultimate tensile strength at rupture of up to 9000 pounds per inch. Belt widths may vary from fifteen inches to twenty-four inches or more. The particular belting material chosen will depend on the requirements of the particular well pumping unit.

One particular embodiment of the well pumping unit under discussion is dimensioned to provide a twenty-five foot stroke in polish rod 20. Currently, a unit with a twenty-five foot stroke is most economically practical because commonly available, off-the-shelf components may be interfaced with the unit. Specifically, a standard long stroke pump is thirty feet long and has a plunger five feet in length. Standard polish rods and standard rods making up the rod string of the pump are made in length which match the size demands of a twenty-five foot stroke pump unit. A comparison of the production figures of a standard walking beam unit with long stroke pumping unit of this invention yields the following interesting results. In pumping a well about one mile deep, a standard walking beam unit with a ten-foot stroke and operating at eight strokes per minute will produce a net lift per minute of forty feet, when a rod stretch of five feet on the lift stroke is taken into account. On the other hand, use of a pumping unit as above disclosed with a twenty-five foot stroke and operating only at four strokes per minute yields a net lift per minute of eighty feet, again taking the five feet of rod stretch on the lift stroke into account. Thus, the present unit is one hundred percent more efficient than a standard walking beam unit. Equally importantly, the long, slower, half speed stroke reduces the number of cycles required per minute and extends rod and tubing life by distributing wear over a greater area.

Figure 2:
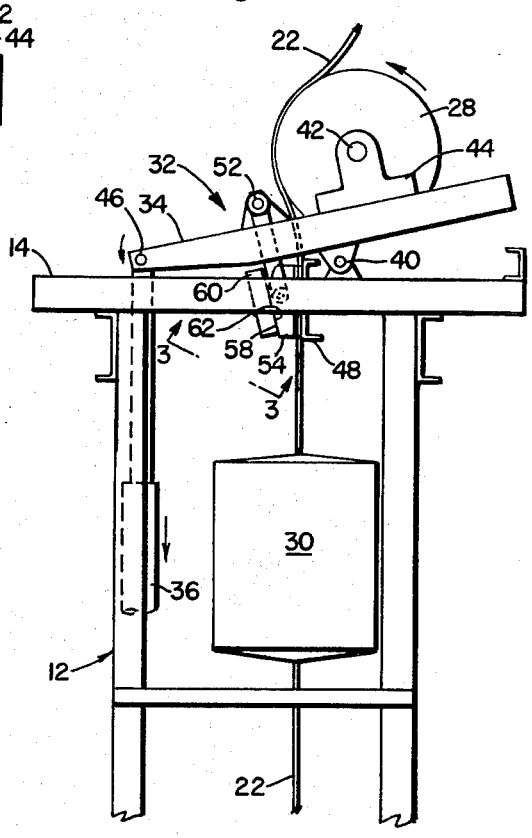
FIG. 2 is a fragmentary side elevation of the top of the pumping unit tower with the fail safe mechanism of the invention in an operative, belt engaging condition.
Figure 3:
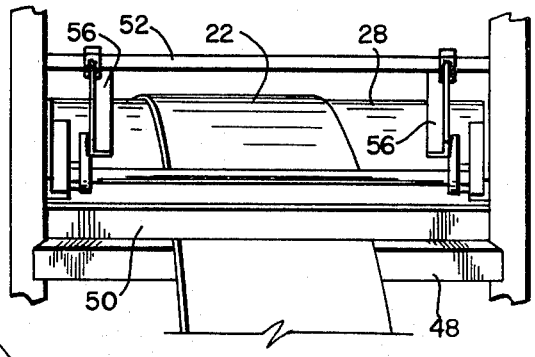
FIG. 3 is a fragmentary perspective view taken along lines 3—3 of FIG. 2.

The fail safe mechanism of the present invention is located at the top of platform 14 and is generally indicated by reference numeral 32. Referring now to FIGS. 2 and 3, the components of the fail safe mechanism 32 include a lever platform 34, a counterweight 36 and a safety brake system 38. Lever platform 34 is pivotally mounted upon the sides of top platform 14, as indicated at 40. Spool 28, over which flexible lift belt 22 is trained, is rotatably mounted on lever platform 34, at 42. It will be noted that the axis of rotation 42 of spool 28 is laterally offset from pivotal mount 40, towards the front of tower structure 12. In other words, the spool is rotatable about an axis generally parallel to the lever platform pivotal axis and a vertical plane drawn through axis 42 is located forwardly, toward the polish rod, of a vertical plane drawn through the lever platform pivotal axis 40. Thus, during normal operation of the pumping unit, with a downward force applied to both sides of the spool 28, by polish rod load on one side and by counterweight 30 on the other, lever platform 34 is forced in a clockwise direction about pivotal mount 40, in the sense of FIG. 1. A rest block 44 is located on the forward portion of top platform 14 and supports the forward portion of lever platform 34. As can be seen in FIG. 1, during normal operation of the pumping unit, top platform 14 and lever platform 34 are arranged in generally parallel fashion. Also, that portion of lift belt 22 between the spool and polish rod 20 is threaded through the forward portions of both lever platform 34 and top platform 40, interiorally of rest block 44.

Counterweight 36 is pivotally suspended at 46 from the opposite end of lever platform 34. Counterweight 36 may be of any suitable construction, such as a length of four-inch O.D. pipe, as shown. Counterweight 36 simply needs to be of sufficient weight to cause lever platform 34 to rotate counterclockwise in the event of a failure as above described with the resultant sudden cessation of downward force being applied to spool 28. The amount of weight required for counterweight 36 may be easily calculated, taking into account the mechanical advantage provided by the length of lever platform 34 between its pivotal mount 40 and mount 46 of counterweight 36 and the rather short lateral offset of spool axis 42 with respect to pivotal mount 40, which in a preferred embodiment is only about four inches.

As can be seen in FIGS. 1–3, safety brake system 38 is located on lever platform 34 and top platform 14, intermediate of pivot mount 40 and suspension point 46 for counterweight 36. Safety brake system 38 includes a stationary brake 48 in the form of a C beam straddling the central portion of top platform 14; the vertical face of brake 48 defines a flat brake surface which is located immediately adjacent that portion of lift belt 22 between spool 28 and counterweight 36. A movable brake 50 is located adjacent stationary brake 48, on the other side of lift belt 22, and is pivotally suspended from lever platform 34, at 52. Movable brake 50 is structured similarly to stationary brake 48 and the vertical face of movable brake 50 facing stationary brake 48 comprises a brake shoe. Each lateral end 54 of movable brake 50 is pivotally attached to a support bracket 56 which, in turn, is attached to lever platform 34 at 52. Each end 54 of brake 50 has a rear, slanted or inclined surface 58 which cooperates with a parallel slanted surface 60 of a wedge block or guide 62 mounted within top platform 14.

As shown in FIG. 2, upon failure of the lift belt between safety brake system 38 and yoke 24 or of the yoke assembly 24 or any of the components of the rod string, downward force applied to spool 28 will immediately cease. Immediately thereafter, lever platform 34 will rotate counterclockwise, in the sense of FIG. 1, under the urging of counterweight 36. Thus, the safety brake system 38 is self-energizing as the pairs of surfaces 60, 62 cause the movable brake 50 to descend and move laterally towards stationary brake 48 to grip and entrap lift belt 22 therebetween. A further, significant safety advantage is provided, in that downward force applied by counterweight 30 during operation of the fail safe mechanism only causes movable brake 50 to more tightly engage lift belt 22 against stationary brake 48 due to the safety wedging action provided by the slanted surfaces 58, 60 of the movable brake ends 54 and the wedge blocks 62, respectively. Of further significance is the fact that the construction of safety brake system 38 is completely uncomplicated, it requires no power at all for operation, and is virtually maintenance free.

Figure 4:
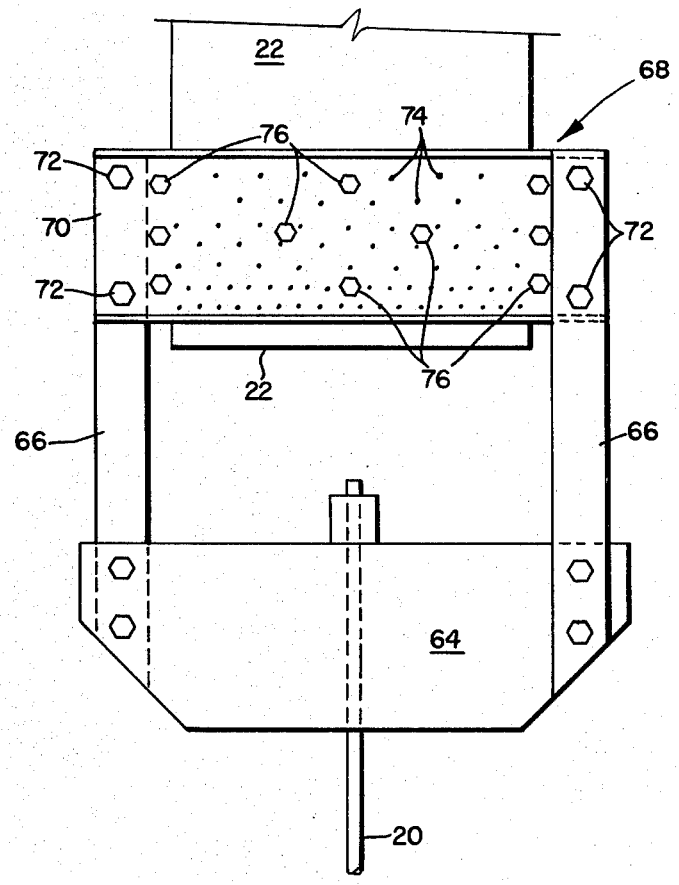
FIG. 4 is a fragmentary elevation view of the yoke of the pumping unit.
Figure 5:
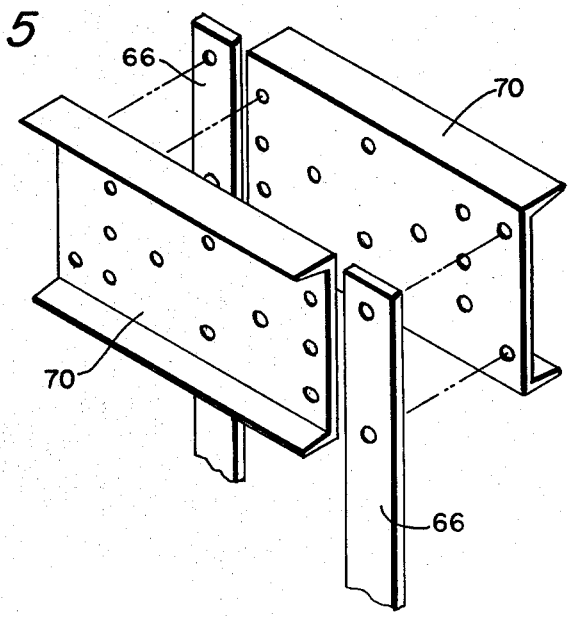
FIG. 5 is an exploded perspective view of the bracket and dual clamping plate feature of the invention, illustrated in elevation in FIG. 4.

Turning now to FIGS. 4–5, a further significant safety feature of this invention is provided by the construction of yoke assembly 24. Yoke assembly 24 includes a cross bar 64, from which the polish rod 20 is centrally suspended, a pair of vertical brackets 66, 66 at each end of cross bar 64, and a clamping plate assembly 68 for securing the free end of flexible lift belt 22 to yoke assembly 24. Clamping plate assembly 68 is unique in that it provides a secure and safe connection for the lift belt to the yoke assembly and polish rod 20; it has been determined by destructive testing that the strength of the connection provided by clamping plate assembly 68 is stronger than the belt itself.

Clamping plate assembly 68 is made up of a pair of plates 70, 70, each of which is only secured to one of the vertical brackets 66 and the other plate, the lower lift belt end being sandwiched between plates 70, 70. In this manner, a very firm engagement of the belt end between the clamping plates is assured; a series of vertical bolts 72 secure the plates together, outside of the sides of the lift belt end. Further attachment of the belt end to plates 70, 70 is accomplished by a predetermined number of vertically spaced, horizontal rows of pins or nails 74, the number of pins in each horizontal row also being of a predetermined number. The count of pins in each row decreases from the bottom of plates 70 to the top of plates 70. Additionally, a diamond pattern of four bolts 76 completes the securement of the lift belt end. This particular arrangement of pins and bolts has been found effective in that a minimal number of holes are created through the lift belt end, which holes, of course, somewhat weaken the tensile strength of the belt end. Simultaneously, a sufficient number of attachments are made through the belt end to assure that the connection will have sufficient strength. In short, there is an even balance of weakening holes being formed and strengthening attachments being made. In one embodiment of the invention, an eighteen-inch belt was secured by means of C beams which comprise the clamp plates 70, 70. Pins 74 were made of standard concrete nails. Eight horizontal rows of pins 74 were used and the rows were spaced vertically about one-inch apart. There were eighteen nails in the bottom row, seventeen nails and one bolt 76 in the next row up from the bottom row, nine nails in each of the four rows above the bottom two rows, and six nails in each of the two top rows. The nails in each row were evenly spaced. After the nails or pins 74 were driven into place, the protruding ends on the other side were either bent over or, preferably, chiseled off. Thus, a secure attachment of the lift belt 22 to the yoke 24 was made, which attachment was found to have a strength greater than the ultimate tensile strength of the belt itself.

Clamping plate assembly 68 may also be employed to secure counterweight 30 to ends of lift belt 22 at either vertical side thereof (FIG. 2), the counterweight being interposed within lift belt 22.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefor intended to be embraced therein.

What is claimed and desired to be secured by Letters Patent is:

1. A long stroke, well pumping unit for a well pump including a conventional polish rod, rod string and sucker rod comprising: a base platform, a tower and the base platform, and a top platform surmounting the tower; rotatable drum means on the base platform and power means for rotating the drum means; a flexible lift belt attached at one end to the drum means and at its other end to the upper end of the polish rod of a well pump; a freely rotatable spool atop the top platform over which the lift belt is trained; a counterweight carried by the lift belt; means for reversing the power means to thereby provide reciprocating movement to the lift belt and thus the polish rod, and self-energizing positive engagement fail safe means for terminating operation of the pumping unit in the event of failure by fracture of the lift belt, polish rod, rod string or sucker rod, comprising: a lever platform pivotally mounted on a generally horizontal axis on the top platform, the spool being rotatably mounted on the lever platform on an axis generally parallel to the lever platform pivotal axis, in a vertical plane located forwardly, toward the polish rod, of a vertical plane drawn through the lever platform pivotal axis, the lever platform having a second counterweight suspended therefrom at a point substantially rearwardly of both the spool axis and the lever platform pivotal axis, stationary brake means mounted on the top platform adjacent the lift belt, on one side thereof, movable brake means pivotally suspended from the lever platform adjacent the lift belt, on a side thereof opposite the stationary brake means, and means mounted on the top platform adjacent the movable brake means for causing movement of the movable brake means towards the stationary brake means upon downward movement of the lever platform about its pivotal axis, whereupon failure by fracture of one of the well components as aforsaid or of the portion of the lift belt between the polish rod and the spool, the lever platform is caused to rotate about its pivotal axis in a direction away from the well head thus causing the movable brake means to descend, engage, and firmly trap the lift belt against the stationary brake means to thus terminate operation of the pumping unit.

2. In a long stroke, well pumping unit for a well pump having a conventional polish rod, rod string and sucker rod, and including a base platform, a tower on the base platform, a top platform surmounting the tower, rotatable drum means on the base platform power means for rotating the drum, a flexible lift belt attached at one end to the drum means and at its other end to the upper end of the polish rod of a well pump, a freely rotatable spool atop the platform, over which the lift belt is trained, a counterweight carried by the lift belt, means for reversing the power means to thereby provide reciprocating movement to the lift belt and thus the polish rod, rod string and sucker rod of the pump; self-energizing, positive engagement fail safe means for terminating operation of the pumping unit in the event of failure by fracture of the lift belt, polish rod, rod string or sucker rod, comprising: a lever platform pivotally mounted on a generally horizontal axis on the top platform, the spool being rotatably mounted on the lever platform on an axis generally parallel to the lever platform pivotal axis, in a vertical plane located forwardly, toward the polish rod, of a vertical plane drawn through the lever platform pivotal axis, the lever platform having a second counterweight suspended therefrom at a point substantially rearwardly of both the spool axis and the lever platform pivotal axis, stationary brake means mounted on the top platform adjacent the lift belt, on one side thereof, movable brake means pivotally suspended from the lever platform adjacent the lift belt, on a side thereof opposite the stationary brake means, and means mounted on the top platform adjacent the movable brake means for causing movement of the movable brake means towards the stationary brake means upon downward movement of the lever platform about its pivotal axis, whereupon failure by fracture of one of the well components as aforsaid or of the portion of the lift belt between the polish rod and the spool, the lever platform is caused to rotate about its pivotal axis in a direction away from the well head thus causing the movable brake means to descend, engage, and firmly trap the lift belt against the stationary brake means to thus terminate operation of the pumping unit.

3. The fail safe means as claimed in claims 1 or 2, further comprising a rest block on the top platform beneath a forward end of the lever platform at a point forward of the spool, the portion of the lift belt between the spool and the polish rod passing between the spool and the rest block, the rest block supporting the lever platform in a stationary, generally horizontal attitude during normal operation of the pumping unit.

4. The fail safe means as claimed in claims 1 or 2 wherein the second lever platform counterweight is freely pivotally suspended from the lever platform.

5. The fail safe means as claimed in claims 1 or 2 wherein the stationary brake means comprise a beam having a flat, brake surface, the beam being affixed to the top platform, laterally thereacross.

6. The fail safe means as claimed in claim 5 wherein the movable brake means comprise a bracket assembly, freely pivotally suspended from said lever platform and a brake shoe, freely pivotally mounted within a lower end of the movable brake means bracket assembly, adjacent a portion of the lift belt between the spool and the drum means, the brake shoe having approximately the same dimensions as those of the stationary brake means flat brake surface.

7. The fail safe means as claimed in claim 6 wherein the means mounted on the top platform for moving the movable brake means toward the stationary brake means comprise a pair of downwardly inclined guides attached to the top platform, one on either side of, and adjacent the lateral ends of, the brake shoe, and cooperating wedges on the lateral ends of the brake shoe, the wedges having slanted surfaces paralleling and riding upon the inclined guides, whereupon actuation of the fail safe mechanism, downward pivotal movement of the lever platform causes the brake shoe wedges to ride along the inclined guides thereby forcing the brake shoe to move toward the stationary flat brake surface to grip and entrap the lift belt therebetween, any continued downward force being applied to the lift belt only causing tighter interengagement of the lift belt by the stationary and movable brake means because of the guiding action of the wedges by the downwardly inclined guides.

8. The fail safe means as claimed in claims 1 or 2 wherein the lift belt other end and the polish rod upper end are interconnected by a yoke assembly, comprising: a cross bar secured medially thereof to the polish rod upper end, a pair of vertical brackets at either end of, and extending upwardly from the cross bar, and a pair of clamping plates secured to the upper ends of the vertical brackets and securing the lift belt other end therebetween, the pair of clamping plates including a patterned array of pin means through both plates and the lift belt other end sandwiched therebetween, the patterend array of pin means including a predetermined number of vertically arrayed horizontal rows of pins, each row of pins having a predetermined number of pins therein.

9. The fail safe means as claimed in claim 8 wherein the numbers of pins in each horizontal row decrease in count from the bottom of the clamping plates to the top thereof.

10. The fail safe means as claimed in claim 8 wherein the clamping plates are arrayed in horizontally offset fashion, one plate being secured only to one vertical bracket and the other plate, and the other plate being secured only to the other vertical bracket and the one plate.

* * * * *